US005385390A

United States Patent [19]

Freeman et al.

[11] Patent Number: 5,385,390

[45] Date of Patent: Jan. 31, 1995

[54] PORTABLE SEAT CARRIER

[76] Inventors: Jimmy Freeman; Richard Freeman, both of 169 Manhattan Ave. #3A, New York, N.Y. 10025; George Spector, 233 Broadway Room 702, New York, N.Y. 10279

[21] Appl. No.: 194,160

[22] Filed: Feb. 9, 1994

[51] Int. Cl.[6] ..... A47C 4/00

[52] U.S. Cl. ..... 297/380; 297/17; 297/183.6; 297/382

[58] Field of Search ..... 297/17, 380–382, 297/440.11, 183

[56] References Cited

U.S. PATENT DOCUMENTS

| | | | |
|---|---|---|---|
| 1,381,136 | 6/1921 | Ribeiro | 297/440.11 X |
| 4,824,171 | 4/1989 | Hollingsworth | 297/380 X |
| 5,100,203 | 3/1992 | Novak | 297/380 X |
| 5,190,350 | 3/1993 | Hwang et al. | 297/380 |

FOREIGN PATENT DOCUMENTS

| | | | |
|---|---|---|---|
| 1071444 | 8/1954 | France | 297/17 |
| 926425 | 5/1963 | United Kingdom | 297/380 |

*Primary Examiner*—Peter R. Brown

[57] ABSTRACT

A portable seat carrier is provided, which consists of a seat in which a person may sit upon. A backrest to support a back of the person, is hinged to the seat. A structure extends from the sides of the seat to removably connect to the backrest for supporting the backrest in an upright position. Components are for carrying the seat and the backrest. When the supporting structure is removed from and placed behind the backrest, the backrest can be folded backwards against the seat, to form a briefcase type configuration, allowing the carrying components to transport the briefcase type configuration to another location.

3 Claims, 1 Drawing Sheet

PORTABLE SEAT CARRIER

BACKGROUND OF THE INVENTION

The instant invention relates generally to collapsible chairs and more specifically it relates to a portable seat carrier, which provides a seat assembly and can be folded up to be carried by handles.

There are available various conventional collapsible chairs which do not provide the novel improvements of the invention herein disclosed.

SUMMARY OF THE INVENTION

A primary object of the present invention is to provide a portable seat carrier that will overcome the shortcomings of the prior art devices.

Another object is to provide a portable seat carrier in which the seat assembly can be folded up to become a briefcase, so that it can be carried by handles.

An additional object is to provide a portable seat carrier which when opened will allow a pair of leg boards which are spring biased to pop down from the seat to become a chair.

A further object is to provide a portable seat carrier that is simple and easy to use.

A still further object is to provide a portable seat carrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
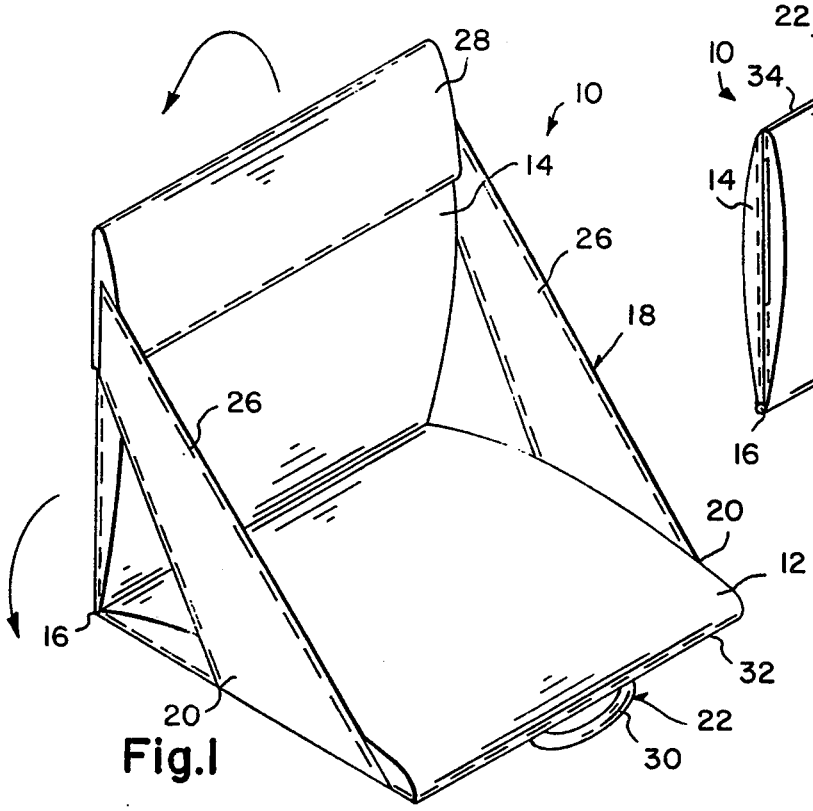
FIG. 1 is a perspective view of a first embodiment of the irritant invention in an opened position.
Figure 3:
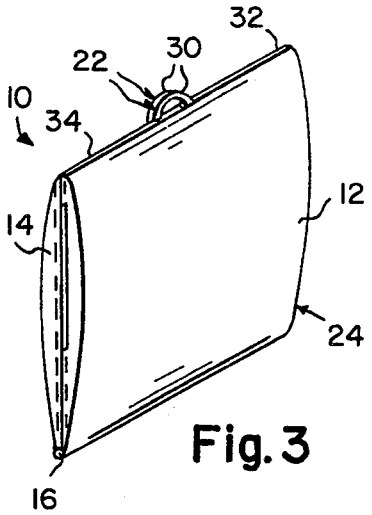
FIG. 3 is a perspective view showing the first embodiment in a closed position ready to be carried.
Figure 2:
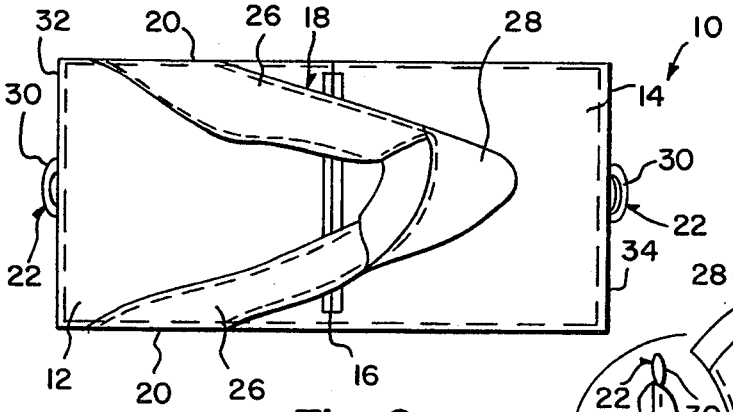
FIG. 2 is a bottom plan view of the first embodiment showing the cover removed and the side arms folded inwardly before folding.

Turning now descriptively to the drawings, in which similar reference characters denote similar elements throughout the several views, FIGS. 1 through 4 illustrate a portable seat carrier 10, which consists of a seat 12 in which a person may sit upon, a backrest 14 to support a back of the person, is hinged at 16 to the seat 12. A structure 18 extends from the sides 20 of the seat 12, to removably connect to the backrest 14 for supporting the backrest 14 in an upright position. Components 22 are for carrying the seat 12 and the backrest 14. When the supporting structure 18 is removed from and placed behind the backrest 14, the backrest 14 can be folded backwards against the seat 12, to form a briefcase type configuration 24, as shown in FIG. 3, allowing the carrying components 22 to transport the briefcase type configuration 24 to another location.

The supporting structure 18 includes a pair of flexible arm straps 26. Each arm strap 26 is attached at a lower end to one side 20 of the seat 12 and extends upwardly at an angle towards the backrest 14. A cover pocket 28 is attached to the upper ends of the arm straps 26, so that the cover pocket 28 can fit over a top portion of the backrest 14.

The carrying components 22 are a pair of handles 30. One handle 30 is attached to a forward edge 32 of the seat 12. The other handle 30 is attached to a top edge 34 of the backrest 14. When the handles 30 are together in the briefcase type configuration 24, they can be gripped by a hand of a person.

Figure 4:
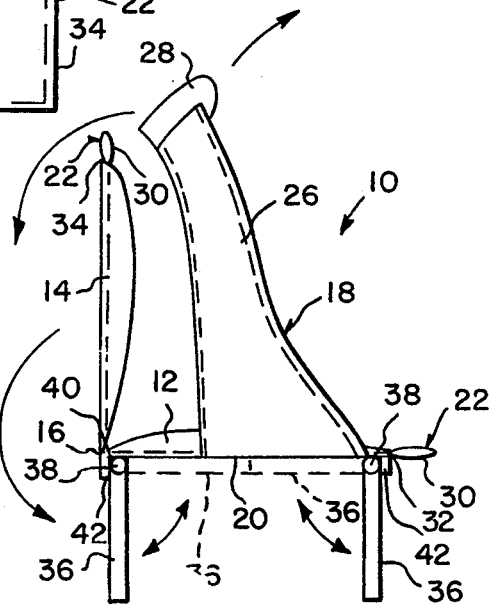
FIG. 4 is a side view of a second embodiment with pop down leg boards, so as to elevate the seat off the floor.

As shown in FIG. 4, the portable seat carrier 10 can further contain a pair of leg boards 36. A pair of spring biased hinges 38 are provided. The first hinge 38 is mounted to an underside of the seat 12 at a rearward edge 40 to the first leg board 36. The second hinge 38 is mounted to the underside of the seat 12 at a forward edge 32 to the second leg board 36. The hinges 38 will normally extend the leg boards 36 down when the backrest 14 is folded away from the seat 12. A pair of stop members 42 are also provided. The first stop member 42 is mounted to the underside of the seat 12 at the rearward edge 40. The second stop member 42 is mounted to the underside of the seat 12 at the forward edge 32, to keep the leg boards 36 in their vertical positions with respect to the seat 12.

OPERATION OF THE INVENTION

To use the portable seat carrier 10 as a seat assembly, a person simply folds the backrest 14 away from the seat 12 to its vertical position. The cover pocket 28 is slipped over the top portion of the backrest 14, to allow the arm straps 26 to support the backrest 14.

To use the portable seat carrier 10 as the briefcase type configuration 24, the person simply removes the cover pocket 26 from the top portion of the backrest 14 and places it behind the backrest 14. The backrest 14 is then folded backwards until it is against the underside of the seat 12. It can then be carried by the handles 30.

If the portion seat carrier 10 is equipped with the leg boards 36, they will go down to their vertical positions by the force of the spring biased hinges 38, when the backrest 14 is folded away from the seat 12, when being placed into the seat assembly.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable seat carrier which comprises:

a) a seat in which a person may sit upon;

b) a backrest, to support a back of the person, rotatively connected to said seat by a pair of hinges;

c) supporting means extending from the sides of said seat to removably connect to said backrest for supporting said backrest in an upright position;

d) carrying means for carrying said seat and said backrest so that when said supporting means is removed from an placed behind said backrest, said backrest can be folded backwards against said seat to form a briefcase type configuration, allowing said carrying means to transport said briefcase type configuration to another location; wherein said supporting means includes:

e) a pair of flexible arm straps, each attached at a lower end to one side of said seat and extending upwardly at an angle towards said backrest; and f) a cover pocket attached to the upper ends of said arm straps, so that said cover pocket fits over a top portion of said backrest.

2. A portable seat carrier as recited in claim 1, wherein said carrying means includes a pair of handles, one said handle attached to a forward edge of said seat and other said handle attached to a top edge of said back, so that when said handles are together in said briefcase type configuration they can be gripped by a hand of a person.

3. A portable seat carrier as recited in claim 2, further including:

a) a pair of leg boards;

b) a pair of spring biased hinges, in which said first hinge is mounted to an underside of said seat at a rearward edge to said first leg board, while said second hinge is mounted to the underside of said seat at a forward edge to said second leg board, whereby said hinges will normally extend said leg boards down away from said seat; and c) a pair of stop members, in which said first stop member is mounted to the underside of said seat at the rearward edge, while said second stop member is mounted to the underside of said seat at the forward edge to keep said leg boards in their vertical positions with respect to said seat.

* * * * *